US011217195B2

(12) United States Patent
Wang

(10) Patent No.: US 11,217,195 B2
(45) Date of Patent: Jan. 4, 2022

(54) DISPLAY APPARATUS AND SHUTTING-DOWN IMAGE-STICKING ELIMINATION METHOD THEREOF

(71) Applicants: HKC Corporation Limited, Guangdong (CN); Chongqing HKC Optoelectronics Technology Co., Ltd., Chongqing (CN)

(72) Inventor: Mingliang Wang, Chongqing (CN)

(73) Assignees: HKC CORPORATION LIMITED, Guangdong (CN); CHONGQING HKC OPTOELECTRONICS TECHNOLOGY CO., LTD., Chongqing (CN)

( * ) Notice: Subject to any disclaimer, the term of this patent is extended or adjusted under 35 U.S.C. 154(b) by 0 days.

(21) Appl. No.: 17/041,995

(22) PCT Filed: Oct. 31, 2018

(86) PCT No.: PCT/CN2018/112916
§ 371 (c)(1),
(2) Date: Sep. 25, 2020

(87) PCT Pub. No.: WO2020/073376
PCT Pub. Date: Apr. 16, 2020

(65) Prior Publication Data

US 2021/0142753 A1 May 13, 2021

(30) Foreign Application Priority Data

Oct. 10, 2018 (CN) ..... 201811180173.0

(51) Int. Cl.
*G09G 3/36* (2006.01)

(52) U.S. Cl.
CPC ..... *G09G 3/3677* (2013.01); *G09G 2310/08* (2013.01); *G09G 2320/046* (2013.01); *G09G 2330/027* (2013.01)

(58) Field of Classification Search
CPC .. G09G 3/3648; G09G 3/3225; G09G 3/3611; G09G 3/3674; G09G 3/3677;
(Continued)

(56) References Cited

U.S. PATENT DOCUMENTS 10,283,076 B1 * 5/2019 Kim ..... G09G 3/3208
2004/0041778 A1 * 3/2004 Hiraki ..... G09G 3/3688 345/100

(Continued)

FOREIGN PATENT DOCUMENTS

CN 1920925 A * 2/2007 ..... G09G 3/36
CN 1920925 A 2/2007

(Continued)

*Primary Examiner* — Michael J Eurice
(74) *Attorney, Agent, or Firm* — Muncy, Geissler, Olds & Lowe, P.C.

(57) ABSTRACT

A display apparatus includes a display panel; a timing control chip, connected to the display panel and including an input data temporary storage module, a data processing module, and a data output module; a plurality of first and second driver chips; a power control chip, connected to the timing control chip, the first and the second driver chips, where the power control chip generates a control signal and transmits the control signal to the second driver chips; and an image-sticking elimination module, including a logic detection unit and a storage module, where an end of the storage module is coupled to the logic detection unit, and an other end of the storage module is electrically coupled to the data output module, where the logic detection unit is coupled to the power control chip and receives the control signal, so as to control a working state of the storage module.

20 Claims, 7 Drawing Sheets

(58) Field of Classification Search
CPC ..... G09G 3/3688; G09G 3/3696; G09G 2310/061; G09G 2310/08; G09G 2320/0257; G09G 2320/046; G09G 2330/027; H04N 21/4318
See application file for complete search history.

(56) References Cited

U.S. PATENT DOCUMENTS

| | | | | |
|---|---|---|---|---|
| 2007/0285428 | A1* | 12/2007 | Foster | G09G 3/3611 345/503 |
| 2008/0309686 | A1* | 12/2008 | Endo | G09G 3/3688 345/690 |
| 2009/0174629 | A1* | 7/2009 | Lee | G09G 3/3225 345/76 |
| 2013/0293600 | A1* | 11/2013 | Lee | G06F 1/3265 345/691 |
| 2016/0027383 | A1 | 1/2016 | Yamakawa | |
| 2016/0284299 | A1* | 9/2016 | Kim | G09G 3/3648 |
| 2017/0263206 | A1* | 9/2017 | Bae | G09G 5/001 |
| 2018/0096656 | A1* | 4/2018 | Lee | G09G 3/2096 |
| 2018/0190218 | A1* | 7/2018 | Jang | G09G 3/3611 |
| 2019/0073981 | A1* | 3/2019 | Xu | G09G 3/3696 |
| 2019/0080653 | A1* | 3/2019 | Kwon | G09G 3/3233 |
| 2019/0348007 | A1* | 11/2019 | Lee | G09G 3/3677 |
| 2020/0004084 | A1* | 1/2020 | Nishihara | G09G 3/006 |

FOREIGN PATENT DOCUMENTS

| | | | |
|---|---|---|---|
| CN | 106157917 | A | 11/2016 |
| CN | 106558289 | A | 4/2017 |
| CN | 107589608 | A | 1/2018 |
| CN | 108597472 | A | 9/2018 |

* cited by examiner

DISPLAY APPARATUS AND SHUTTING-DOWN IMAGE-STICKING ELIMINATION METHOD THEREOF

BACKGROUND

Technical Field

This application relates to an image-sticking elimination method, and in particular, to a display apparatus and a shutting-down image-sticking elimination method thereof.

Related Art

Liquid crystal displays (LCDs) have been widely applied in recent years. As drive technology is improved, the LCDs have advantages such as low electric power consumption, a thin and light design, and low-voltage driving. Currently, the LCDs have been widely applied to camcorders, notebook computers, desktop displays, and various projection devices.

In addition, an LCD apparatus usually includes a gate driver circuit, a source driver circuit, and a pixel array. The pixel array includes a plurality of pixel circuits, and each pixel circuit is switched on or off according to a scanning signal provided by the gate driver circuit. Moreover, a data screen is displayed according to a data signal provided by the source driver circuit.

Because of being limited by charging and discharging speeds of liquid crystals, some charges may remain on a liquid crystal panel during shutting-down and may cause shutting-down image-sticking visible to human eyes. Currently, a common approach is generating a control signal during shutting-down, so that second driver chips (gate drivers) simultaneously switch on TFT switches of all channels, and the charges are expected to be released as soon as possible. However, at this time, because output of first driver chips (data drivers) is not fixed, discharging effects are different as screen display data is different. Therefore, this method cannot ensure that the charges can be completely eliminated. Hence, to overcome the foregoing technical disadvantage when the second driver chips (gate drivers) discharge the liquid crystal panel, a shutting-down image-sticking elimination method having low manufacturing costs and an easy machining process is provided.

SUMMARY

To resolve the foregoing technical problem, an objective of this application is to provide a display apparatus and a shutting-down image-sticking elimination method. Design of driver chips is changed, so that when a shutdown signal is initiated, first driver chips all output black screen data, so as to eliminate image-sticking in terms of screen display, thereby improving display screen quality.

The objective of this application is achieved and the technical problem of this application is resolved by using the following technical solution. A display apparatus is provided according to this application, comprising: a display panel; a timing control chip, electrically connected to the display panel, where the timing control chip comprises an input data temporary storage module, a data processing module, and a data output module; a plurality of first driver chips and a plurality of second driver chips, electrically connected to the display panel; a power control chip, electrically connected to the timing control chip, the first driver chips, and the second driver chips, where the power control chip generates a control signal and transmits the control signal to the second driver chips; and an image-sticking elimination module, comprising a logic detection unit and a storage module, where an end of the storage module is electrically coupled to the logic detection unit, where the storage module stores black screen data; an other end of the storage module is electrically coupled to the data output module, and the logic detection unit is electrically coupled to the power control chip and receives the control signal generated by the power driver chip; and a working state of the storage module is controlled according to a potential state of the control signal.

The technical problem of this application may be further resolved by taking the following technical measures.

In an embodiment of this application, the input data temporary storage module is electrically coupled to the data processing module.

In an embodiment of this application, the data processing module is electrically coupled to the data output module.

In an embodiment of this application, the data output module has a plurality of output ends, and is electrically coupled to the display panel.

In an embodiment of this application, when the storage module receives the control signal switched from a high potential to a low potential, all scanning lines are switched on simultaneously, the storage module outputs the black screen data to the display panel, and the display panel displays a black screen.

In an embodiment of this application, the display apparatus further comprises a flexible connection flat cable and a printed circuit board, wherein the flexible connection flat cable is electrically coupled to the printed circuit board In an embodiment of this application, an other end of the flexible connection flat cable is electrically coupled to the power control chip.

In an embodiment of this application, the first driver chip is a source driver chip, and the second driver chip is a gate driver chip.

Another objective of this application is to provide a shutting-down image-sticking elimination method of a display apparatus, comprising: receiving, by using an image-sticking elimination module, a control signal sent by a power control chip, to obtain a potential state of the control signal; and controlling, according to the potential state of the control signal, whether or not a plurality of driver circuit components enters a shutdown mode, where when the control signal is switched from a high potential to a low potential, the control signal triggers the storage module to output black screen data. The driver circuit components comprise a timing control module, a plurality of first driver chips, a plurality of second driver chips, an image-sticking elimination module, and a power control chip, and the shutdown mode is outputting black screen data.

In an embodiment of this application, the step of controlling, according to the potential state of the control signal, whether or not a plurality of driver circuit components enters a shutdown mode comprises: when the control signal is switched from a high potential to a low potential, switching on the image-sticking elimination module and switching on all scanning lines simultaneously; and outputting, by the data output module, only black screen data to a display panel, and displaying, by the display panel, a black screen.

In an embodiment of this application, the image-sticking elimination module comprises a logic detection unit and a storage module, where the storage module is electrically coupled to the logic detection unit, the storage module is electrically coupled to the data output module, and the logic detection unit is coupled to the power control chip and receives the control signal generated by the power driver chip.

In an embodiment of this application, the first driver chips, the second driver chips, and the power control chip are separately electrically connected to a timing control chip, and the timing control chip is configured to drive the first driver chips, the second driver chips, and the power control chip.

Another objective of this application is to provide a display apparatus, comprising: a display panel; a timing control chip, electrically connected to the display panel, where the timing control chip comprises an input data temporary storage module, a data processing module, and a data output module; a plurality of first driver chips and a plurality of second driver chips, electrically connected to the display panel; a power control chip, electrically connected to the first driver chips and the second driver chips separately, where the power control chip generates a control signal and transmits the control signal to the second driver chips; and an image-sticking elimination module, comprising a logic detection unit and a storage module, where an end of the storage module is electrically coupled to the logic detection unit, where the storage module stores black screen data; an other end of the storage module is electrically coupled to the data output module, and the logic detection unit is electrically coupled to the power control chip and receives the control signal generated by the power driver chip; a working state of the storage module is controlled according to a potential state of the control signal; and the storage module receives the control signal switched from a high potential to a low potential, the storage module outputs black screen data, and when the control signal is at a low potential, all scanning lines of the display panel are switched on simultaneously.

In this application, by means of changing design of driver chips, when a shutdown signal is initiated, first driver chips all output black screen data, so as to eliminate image-sticking in terms of screen display, thereby improving display screen quality.

DETAILED DESCRIPTION

The following embodiments are described with reference to the accompanying drawings, and are used to exemplify particular embodiments for implementation of this application. Terms about directions mentioned in this application, such as "on", "below", "front", "back", "left", "right", "in", "out", and "side face", merely refer to directions in the accompanying drawings. Therefore, the used terms about directions are used to describe and understand this application, and are not intended to limit this application.

The accompanying drawings and the description are considered to be essentially exemplary, rather than limitative. In the figures, units with similar structures are represented by using the same reference number. In addition, for understanding and ease of description, the size and the thickness of each component shown in the accompanying drawings are arbitrarily shown, but this application is not limited thereto.

In the accompanying drawings, for clarity, thicknesses of a layer, a film, a panel, an area, and the like are enlarged. In the accompanying drawings, for understanding and ease of description, thicknesses of some layers and areas are enlarged. It should be understood that when a component such as a layer, a film, an area, or a base is described to be "on" "another component", the component may be directly on the another component, or there may be an intermediate component.

In addition, throughout this specification, unless otherwise explicitly described to have an opposite meaning, the word "include" is understood as including the component, but not excluding any other component. In addition, throughout this specification, "on" means that one is located above or below a target component and does not necessarily mean that one is located on the top based on a gravity direction.

To further describe the technical measures taken in this application to achieve the predetermined inventive objectives and effects thereof, specific implementations, structures, features, and effects of a display apparatus and a shutting-down image-sticking elimination method thereof provided according to this application are described below in detail with reference to the accompanying drawings and preferred embodiments.

A display panel in this application is, for example, a quantum dots light-emitting diode (QLED) panel, an organic light-emitting diode (OLED) panel, or a liquid crystal display (LCD) panel, but is not limited thereto. The LCD panel includes: an active array (thin film transistor (TFT)) substrate, a color filter (CF) substrate, and a liquid crystal layer formed between the two substrates.

In an embodiment, the display panel in this application may be a curved-surface display panel.

In an embodiment of this application, an active array (TFT) and a CF in this application may be formed on a same substrate.

Figure 1:
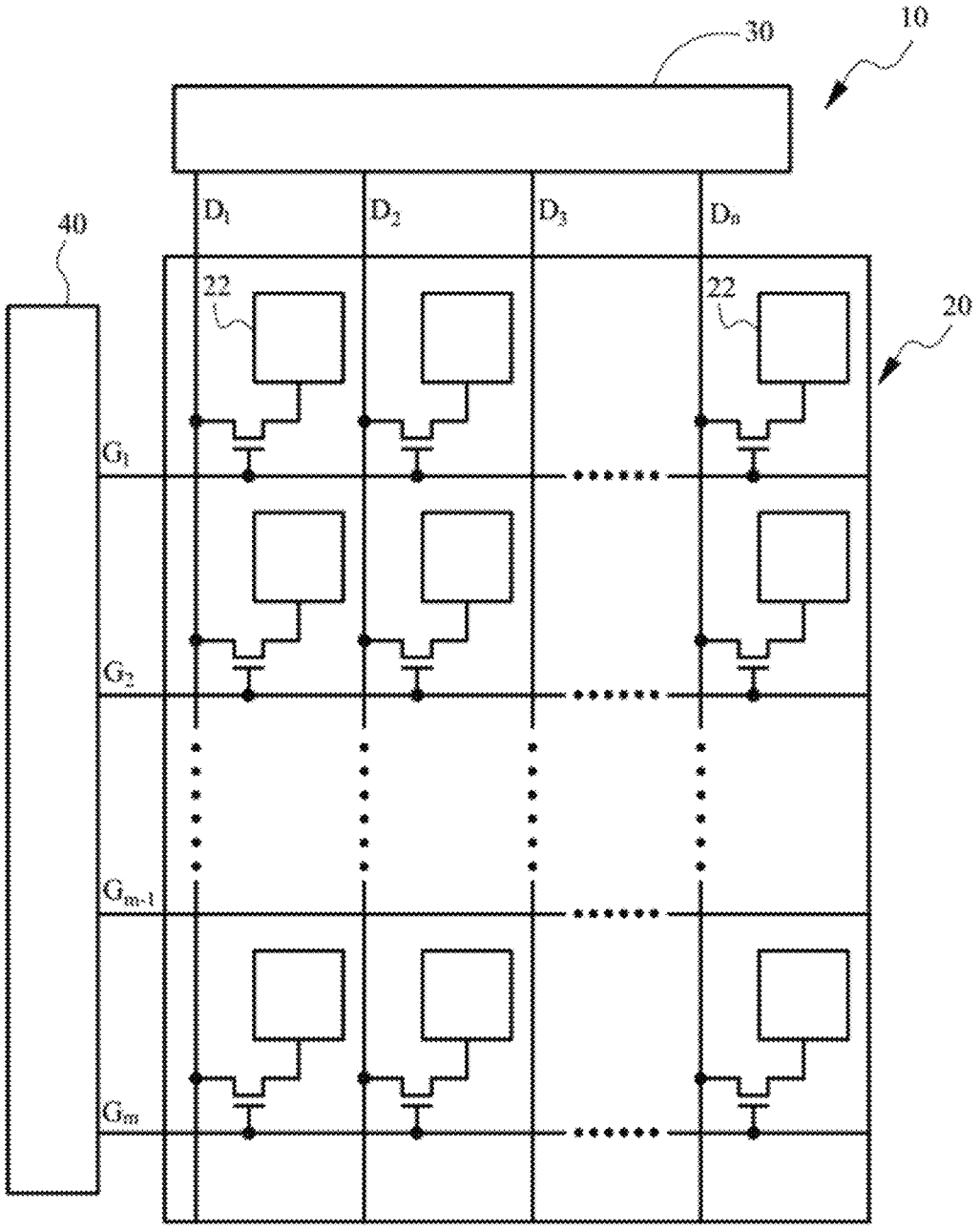
FIG. 1 is a schematic diagram of an exemplary display panel including a display pixel array.

FIG. 1 is a schematic diagram of an exemplary display panel including a display pixel array. Referring to FIG. 1, a display panel 10 includes a display module 20 including a plurality of pixels 22, 22' arranged in a two-dimensional array. The pixels are controlled and driven by a plurality of data lines D1, D2, . . . , Dn and a plurality of gate lines G1, G2, . . . , Gm. A data signal of each data line is provided by a data driver chip 30, and a gate signal of each gate line is provided by a gate driver chip 40.

Figure 2:
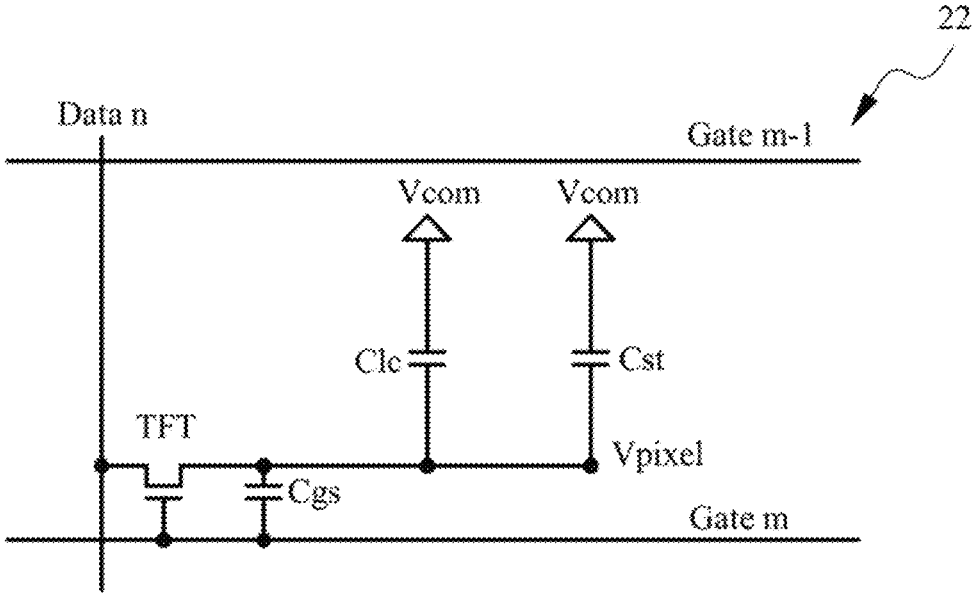
FIG. 2 shows a schematic diagram of an equivalent capacitance load related to a display pixel and an equivalent capacitance load of a relevant switch component in an exemplary display panel.
Figure 3:
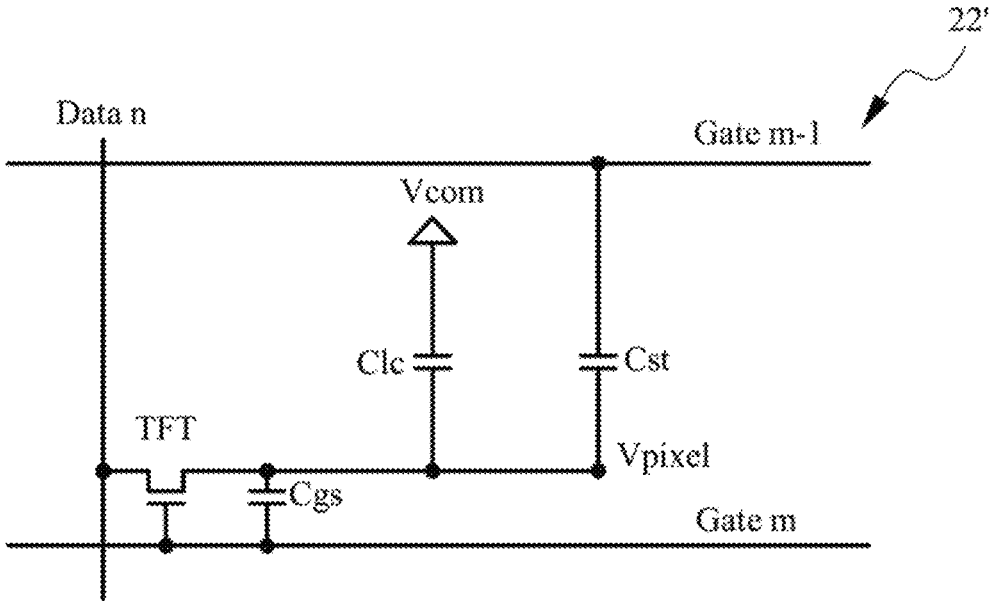
FIG. 3 shows a schematic diagram of an equivalent capacitance load related to a display pixel and an equivalent capacitance load of a relevant switch component in another exemplary display panel.

FIG. 2 shows a schematic diagram of an equivalent capacitance load related to a display pixel and an equivalent capacitance load of a relevant switch component in an exemplary display panel, and FIG. 3 shows a schematic diagram of an equivalent capacitance load related to a display pixel and an equivalent capacitance load of a relevant switch component in another exemplary display panel. Referring to FIG. 2 and FIG. 3, each pixel 22 or 22' is related to a plurality of capacitors such as a capacitor Clc including and related to a liquid crystal layer capacitor located between upper-lever and lower-layer electrodes, an additional charge storage capacitor Cst maintaining a voltage at a value Vpixel after a gate line signal passes through the additional charge storage capacitor Cst, and a capacitor Cgs related to a gate end and a source end of a switch component (an active switch, TFT). A total capacitance value of a pixel of a display panel may change because of impacts of a pixel size, a thickness of a liquid crystal layer, a size of a storage capacitor, and several other technologies well-known to persons skilled in the art. As shown in FIG. 2, Clc and Cst both are connected to a common voltage Vcom. As shown in FIG. 3, Cst is connected to a gate line.

Figure 4:
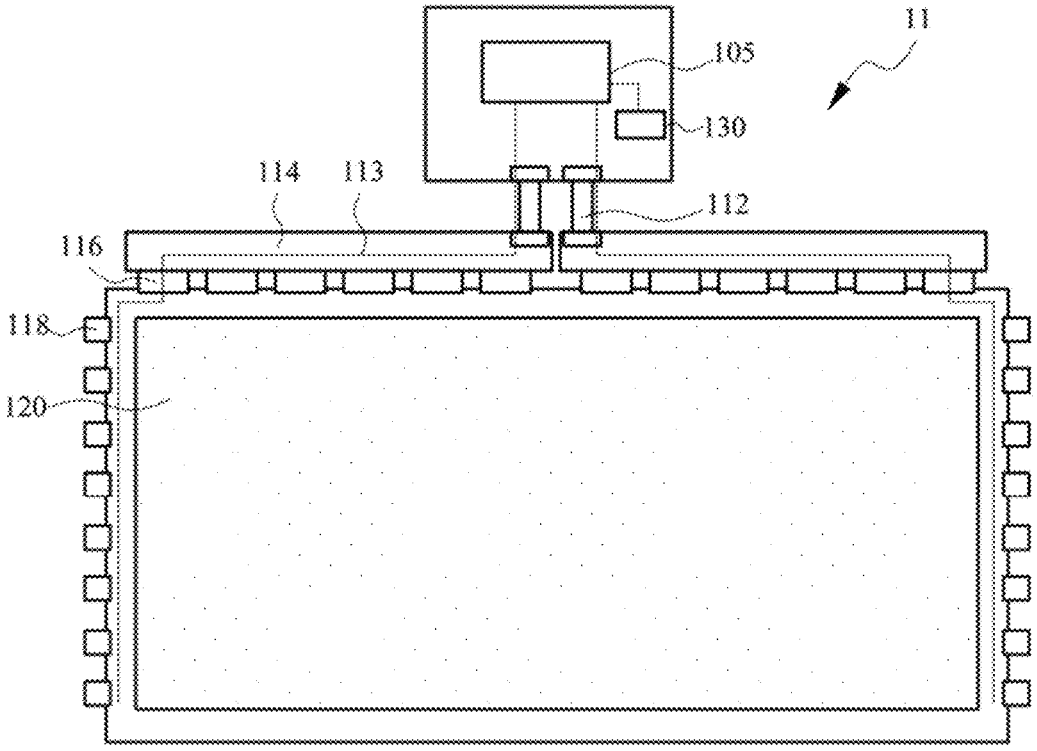
FIG. 4 is a schematic diagram of a display apparatus according to an embodiment of this application.
Figure 5:
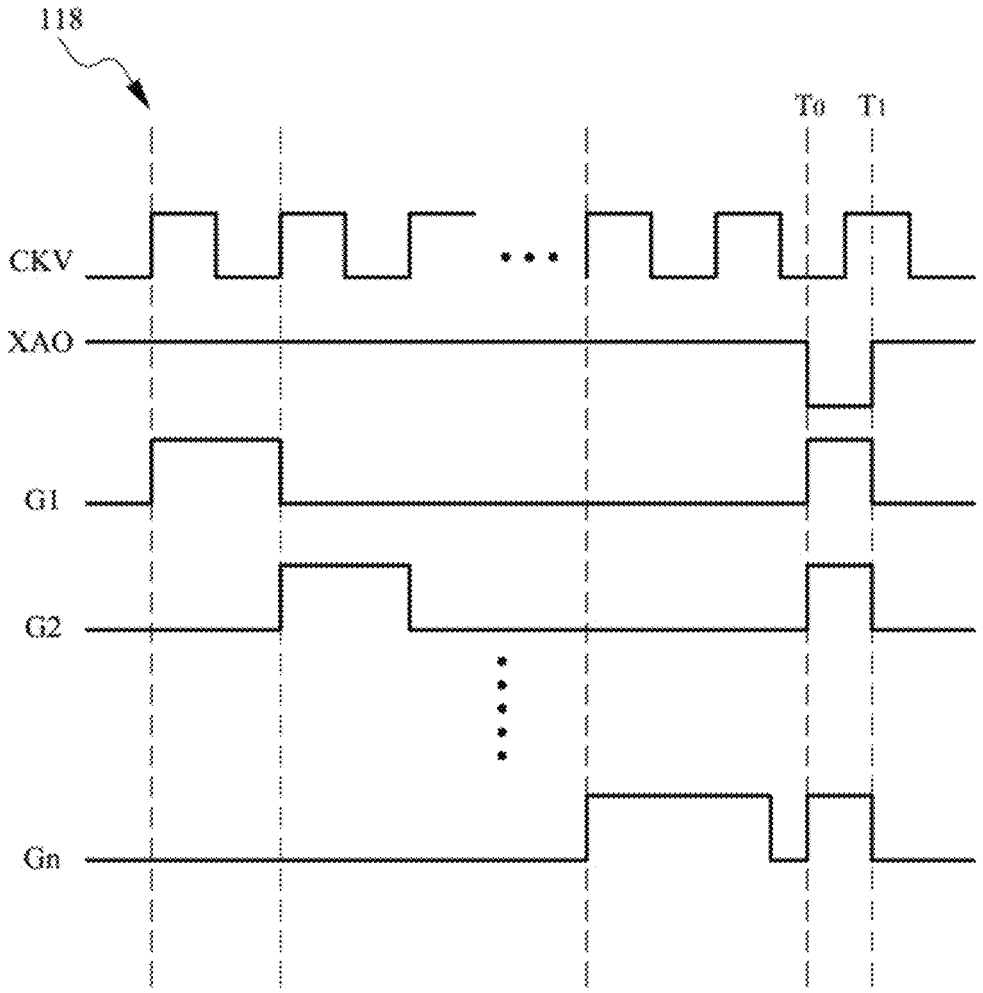
FIG. 5 is a schematic operation diagram of a second driver chip according to an embodiment of this application.
Figure 6:
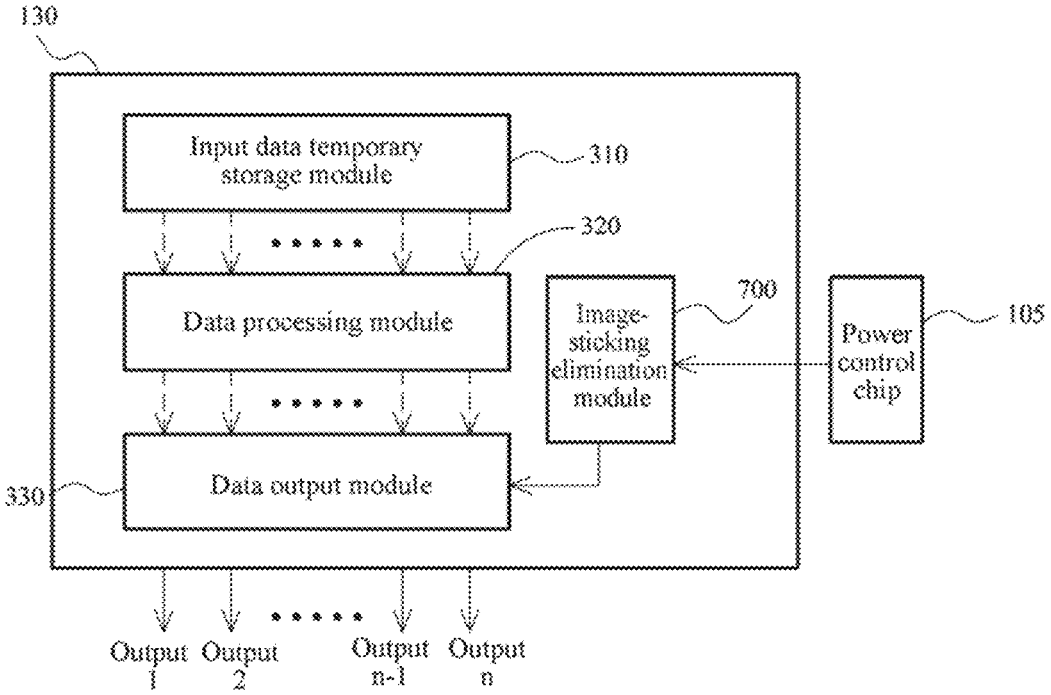
FIG. 6 is a block diagram of a timing control chip of a display apparatus according to an embodiment of this application.
Figure 7:
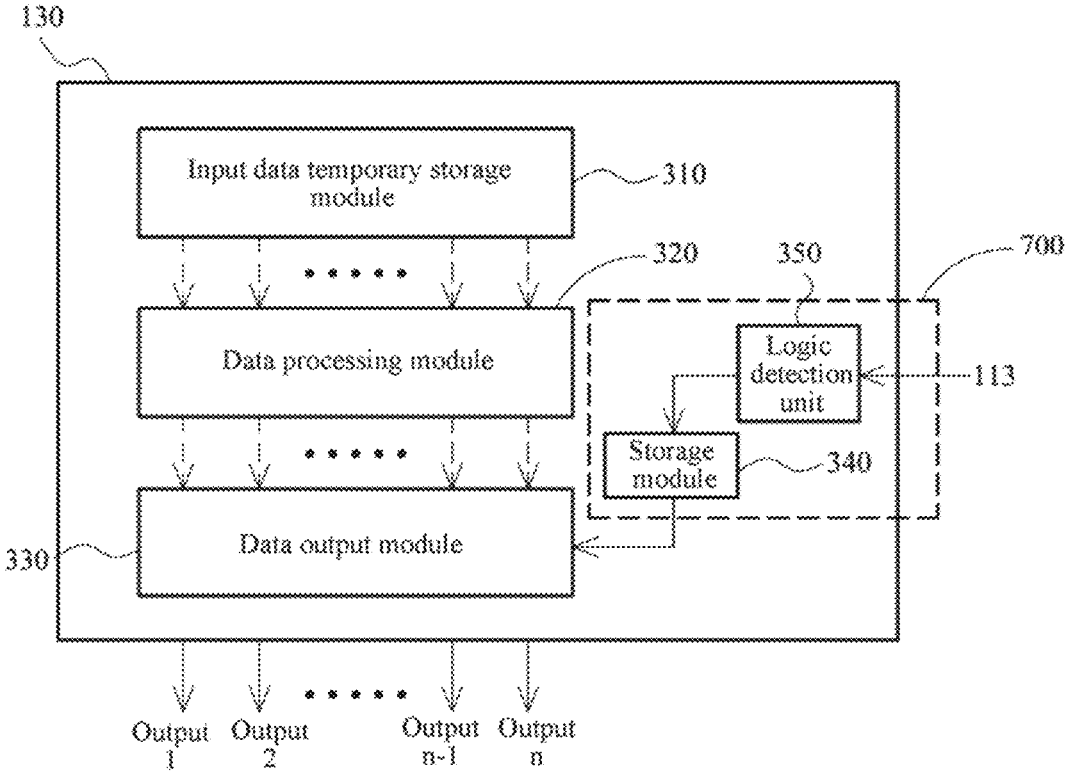
FIG. 7 is a schematic diagram of a timing control chip according to an embodiment of this application.

FIG. 4 is a schematic diagram of a display apparatus according to an embodiment of this application, FIG. 5 is a schematic operation diagram of a timing control chip according to an embodiment of this application, FIG. 6 is a block diagram of a timing control chip of a display apparatus according to an embodiment of this application, and FIG. 7 is a schematic diagram of a timing control chip according to an embodiment of this application. Referring to FIG. 4, FIG. 6, and FIG. 7, in an embodiment of this application, a display apparatus 11 includes: a display panel 120; a timing control chip 130, electrically connected to the display panel 120, where the timing control chip 130 includes an input data temporary storage module 310, a data processing module 320, and a data output module 330; a plurality of first driver chips 116 (for example, source driver chips) and a plurality of second driver chips 118 (for example, gate driver chips), electrically connected to the display panel 120; a power control chip 105, electrically connected to the timing control chip 130, the first driver chips 116, and the second driver chips 118 separately, to control supplying power to the first driver chips 116 and the second driver chips 118; and an image-sticking elimination module 700, including a logic detection unit 350 and a storage module 340, where an end of the storage module 340 is electrically coupled to the logic detection unit 350, an other end of the storage module 340 is electrically coupled to the data output module 330, the logic detection unit 350 is a kind of signal detector which is electrically coupled to the power control chip 105 and receives a control signal 113 (that is, an XAO signal) generated by the power driver chip 105, and the storage module 340 stores black screen data. A working state of the storage module 340 is controlled according to a potential state of the control signal 113, and if the control signal 113 is at a low potential L, all scanning lines of the display panel 120 are switched on simultaneously.

In an embodiment, the input data temporary storage module 310 is electrically coupled to the data processing module 320.

In an embodiment, the data processing module 320 is electrically coupled to the data output module 330.

In an embodiment, the data output module 330 has a plurality of output ends, and is electrically coupled to the display panel.

In an embodiment, when the storage module 340 receives the control signal 113 switched from a high potential H to a low potential L, the storage module 340 simultaneously switches on the scanning lines by means of the first driver chips 116 and the second driver chips 118, and outputs the black screen data to the display panel.

A flexible connection flat cable 112 and a printed circuit board 114 are further included, where the flexible connection flat cable 112 is electrically coupled to the printed circuit board 114, and an other end of the flexible connection flat cable 112 is electrically coupled to the power control chip 105.

Referring to FIG. 4, in an embodiment, in an overall driving architecture of a liquid crystal panel, the power control chip 105 generates a control signal 113 and transmits the control signal 113 through a flexible flat cable 112, a driver board 114, and wiring over glass to the second driver chips 118 finally. In a normal state, the control signal 113 is at a high potential H. When detecting shutting-down, the power control chip 105 pulls down the control signal 113 to a low potential L. At this time, the logic detection unit 350 detects that the control signal 113 is switched from the high potential H to the low potential L, and the storage module 340 outputs black screen data, so that a viewer also sees a black screen during the shutting-down.

Referring to FIG. 4 and FIG. 5, in an embodiment, CKV is a working frequency, G1 to Gn are output channels of the second driver chips 118. It could be learned from FIG. 5 that under the effect of the frequency CKV, lines of gates are switched on successively. However, under the effect of frequencies T0 to T1, when the control signal 113 (XAO) is at L, all channels simultaneously switch on ON(1) and ON(2) to ON(n). At the same time, the storage module 340 switches on the scanning lines by means of the first driver chips 116 and the second driver chips 118, and outputs black screen data to a display panel. A black screen is output by means of the display panel. In this way, even if a backlight is not completely turned off, a viewer sees the black screen. Meanwhile, charges internally stored by the display panel are ensured to be released as soon as possible, and shutting-down image-sticking elimination is ensured.

Referring to FIG. 4 to FIG. 7, in an embodiment of this application, a shutting-down image-sticking elimination method of a display apparatus includes: receiving, by using an image-sticking elimination module 700, a control signal 113 sent by a power control chip 105, to obtain a potential state of the control signal 113; and controlling, according to the potential state of the control signal 113, whether or not a plurality of driver circuit components enters a shutdown mode, where when the control signal 113 is switched from a high potential H to a low potential L, the control signal 113 triggers the storage module 340 to output black screen data. The driver circuit components include a timing control module 130, a plurality of first driver chips 116 (for example, source driver chips), a plurality of second driver chips 118 (for example, gate driver chips), an image-sticking elimination module 700, and a power control chip 105, and the shutdown mode is outputting black screen data.

In an embodiment, the step of deciding and controlling, according to the potential state of the control signal 113, whether or not a plurality of driver circuit components enters a shutdown mode includes: when the control signal 113 is switched from a high potential H to a low potential L, switching on a logic detection unit 350 and a storage module 340 in the image-sticking elimination module 700; and outputting, by the data output module 330, only black screen data to a display panel, to display a black screen.

In an embodiment, the shutting-down image-sticking elimination method includes: electrically connecting to the power control chip 105 through a timing control chip 130, to drive the first driver chips 116, the second driver chips 118, and the power control chip 105.

In an embodiment, in the shutting-down image-sticking elimination method, the image-sticking elimination module 700 includes a logic detection unit 350 and a storage module 340, where the storage module 340 is electrically coupled to the logic detection unit 350, the storage module 340 is electrically coupled to the data output module 330, and the logic detection unit 350 is coupled to the power control chip 105 and receives the control signal 113 generated by the power driver chip 105.

In an embodiment of this application, a display device 11 includes a control part (for example, a multi-band antenna) (not shown in the figure), and further includes the display panel 120 (for example, a QLED panel, an OLED panel, or an LCD panel, and no limitation is imposed herein).

In this application, by means of changing design of driver chips, when a shutdown signal is initiated, first driver chips all output black screen data, so as to eliminate image-sticking in terms of screen display, thereby improving display screen quality.

The wordings such as "in some embodiments" and "in various embodiments" are repeatedly used. The wordings usually refer to different embodiments, but they may alternatively refer to a same embodiment. The words, such as "comprise", "have", and "include", are synonyms, unless other meanings are indicated in the context thereof.

The foregoing descriptions are merely specific embodiments of this application, and are not intended to limit this application in any form. Although this application has been disclosed above through the specific embodiments, the embodiments are not intended to limit this application. Any person skilled in the art can make some variations or modifications, namely, equivalent changes, according to the foregoing disclosed technical content to obtain equivalent embodiments without departing from the scope of the technical solutions of this application. Any simple amendment, equivalent change, or modification made to the foregoing embodiments according to the technical essence of this application without departing from the content of the technical solutions of this application shall fall within the scope of the technical solutions of this application.

What is claimed is:

1. A display apparatus, comprising:

a display panel;

a timing control chip, electrically connected to the display panel, wherein the timing control chip comprises an input data temporary storage module, a data processing module, and a data output module;

a plurality of first driver chips and a plurality of second driver chips, electrically connected to the display panel;

a power control chip, electrically connected to the timing control chip, the first driver chips, and the second driver chips, wherein the power control chip generates a control signal and transmits the control signal to the second driver chips; and an image-sticking elimination module, comprising a signal detector and a storage module, wherein an end of the storage module is electrically coupled to the signal detector, wherein the storage module stores black screen data;

wherein an other end of the storage module is electrically coupled to the data output module, and the signal detector is electrically coupled to the power control chip and receives the control signal generated by the power control chip; and a working state of the storage module is controlled according to a potential state of the control signal, and if the control signal is at a low potential, all scanning lines of the display panel are switched on simultaneously;

when a shutdown signal is initiated, the first driver chips all output the black screen data to eliminate image-sticking in terms of a screen display.

2. The display apparatus according to claim 1, wherein the input data temporary storage module is electrically coupled to the data processing module.

3. The display apparatus according to claim 1, wherein the data processing module is electrically coupled to the data output module.

4. The display apparatus according to claim 1, wherein the data output module has a plurality of output ends, and is electrically coupled to the display panel.

5. The display apparatus according to claim 1, wherein the first driver chip is a source driver chip.

6. The display apparatus according to claim 1, wherein the second driver chip is a gate driver chip.

7. The display apparatus according to claim 1, wherein when the storage module receives the control signal switched from a high potential to a low potential, all scanning lines are switched on simultaneously.

8. The display apparatus according to claim 5, wherein the storage module outputs the black screen data to the display panel.

9. The display apparatus according to claim 1, further comprising a flexible connection flat cable and a printed circuit board, wherein the flexible connection flat cable is electrically coupled to the printed circuit board.

10. The display apparatus according to claim 7, wherein an other end of the flexible connection flat cable is electrically coupled to the power control chip.

11. A shutting-down image-sticking elimination method of athe display apparatus of claim 1, comprising:

receiving, by using an image-sticking elimination module, a control signal sent by a power control chip, to obtain a potential state of the control signal; and controlling, according to the potential state of the control signal, whether or not a plurality of driver circuit components enters a shutdown mode, wherein when the control signal is switched from a high potential to a low potential, the control signal triggers the storage module to output black screen data, wherein:

the driver circuit components comprise a timing control module, a plurality of first driver chips, a plurality of second driver chips, an image-sticking elimination module, and a power control chip, and the shutdown mode is that when a shutdown signal is initiated, the first driver chips all output black screen data to eliminate image-sticking in terms of a screen display.

12. The shutting-down image-sticking elimination method of a display apparatus according to claim 11, wherein the power control chip is electrically connected to a timing control chip.

13. The shutting-down image-sticking elimination method of a display apparatus according to claim 12, wherein the timing control chip drives the first driver chips, the second driver chips, and the power control chip.

14. The shutting-down image-sticking elimination method of a display apparatus according to claim 11, wherein the step of controlling, according to the potential state of the control signal, whether or not a plurality of driver circuit components enters a shutdown mode comprises:

when the control signal is switched from a high potential to a low potential, switching on the image-sticking elimination module and switching on all scanning lines simultaneously.

15. The shutting-down image-sticking elimination method of a display apparatus according to claim 14, wherein the data output module outputs only black screen data to a display panel, and the display panel displays a black screen.

16. The shutting-down image-sticking elimination method of a display apparatus according to claim 13, wherein the image-sticking elimination module comprises the signal detector and the storage module, wherein the storage module is electrically coupled to the signal detector.

17. The shutting-down image-sticking elimination method of a display apparatus according to claim 16, wherein the storage module is electrically coupled to the data output module.

18. The shutting-down image-sticking elimination method of a display apparatus according to claim 16, wherein the signal detector is coupled to the power control chip.

19. The shutting-down image-sticking elimination method of a display apparatus according to claim 18, wherein the signal detector receives the control signal generated by the power driver chip.

20. A display apparatus, comprising:

a display panel;

a timing control chip, electrically connected to the display panel, wherein the timing control chip comprises an input data temporary storage module, a data processing module, and a data output module;

a plurality of first driver chips and a plurality of second driver chips, electrically connected to the display panel;

a power control chip, electrically connected to the first driver chips and the second driver chips separately, wherein the power control chip generates a control signal and transmits the control signal to the second driver chips; and an image-sticking elimination module, comprising a signal detector and a storage module, wherein an end of the storage module is electrically coupled to the signal detector, wherein the storage module stores black screen data;

an other end of the storage module is electrically coupled to the data output module, and the signal detector is electrically coupled to the power control chip and receives the control signal generated by the power driver chip;

a working state of the storage module is controlled according to a potential state of the control signal; and the storage module receives the control signal switched from a high potential to a low potential, the storage module outputs black screen data, and when the control signal is at a low potential, all scanning lines of the display panel are switched on simultaneously;

when a shutdown signal is initiated, the first driver chips all output the black screen data to eliminate image-sticking in terms of a screen display.

* * * * *